US005381904A

United States Patent [19]

Thurell

[11] Patent Number: 5,381,904

[45] Date of Patent: Jan. 17, 1995

[54] DISPENSER FOR MEDICAL PREPARATIONS AND INSERT THEREFOR

[75] Inventor: Peter Thurell, Stocksund, Sweden

[73] Assignee: Item Development AB, Stocksund, Sweden

[21] Appl. No.: 170,168

[22] PCT Filed: Oct. 28, 1993

[86] PCT No.: PCT/SE93/00891

§ 371 Date: Dec. 23, 1993

§ 102(e) Date: Dec. 23, 1993

[87] PCT Pub. No.: WO94/09742

PCT Pub. Date: May 11, 1994

[30] Foreign Application Priority Data

Oct. 28, 1992 [SE] Sweden ..... 9203168

[51] Int. Cl.[6] ..... B65D 83/04

[52] U.S. Cl. ..... 206/538; 206/539

[58] Field of Search ..... 206/538, 539, 533

[56] References Cited

U.S. PATENT DOCUMENTS 2,410,923 11/1946 Beardsley .
3,527,190 9/1970 Huck .
3,812,963 5/1974 Zahurahec et al. .
3,942,630 3/1976 Phillips .
4,038,937 8/1977 Möe .
4,062,445 12/1977 Möe .
4,535,890 8/1985 Artusi ..... 206/539
4,693,371 9/1987 Malpass .
4,872,559 10/1989 Schoon .
5,115,911 5/1992 Schulte et al. ..... 206/538

FOREIGN PATENT DOCUMENTS 0250636 1/1988 European Pat. Off. .
2365496 5/1978 France ..... 206/538
2575730 7/1986 France .
1909932 5/1977 Germany .
WO92/02202 2/1992 WIPO .

*Primary Examiner*—David T. Fidei
*Attorney, Agent, or Firm*—Burns, Doane, Swecker & Mathis

[57] ABSTRACT

A dispenser for medical preparations comprises a rectangular box (1) which releasably accommodates an insert (3) for containing a series of countersunk compartments (4) for receiving the medical preparations, the box having a top cover with slidable shutters (5) adapted to be opened at least partially to permit access to the contents of the respective compartments, a protective lid (7, 7") being removably arranged the top of the insert and covering the compartments and being openable to permit the abovementioned access. The lid (7; 7") can be peeled off or slidably removed from the insert (2) and has a grip portion (10; 10") that can be seized externally of one side of the box permit peeling off or sliding of the lid respectively through an opening or a slot (6; 6") provided in said box side.

9 Claims, 2 Drawing Sheets

DISPENSER FOR MEDICAL PREPARATIONS AND INSERT THEREFOR

BACKGROUND OF AND SUMMARY OF THE INVENTION

The invention relates to a dispenser for medical preparations and an insert therefor.

Over the past 10–15 years, dispensers for medical preparations consisting of a box which releasably accommodates an insert with a number of compartments, have found extended employment. The compartments contain medical preparations, "pills", and are arranged in a specific manner, e.g. in columns and rows, so that the patient or the nurse can easily find one or more medical preparations that the patient is to take at a predetermined point of time. The box may, for example, have markings indicating the day of the week and the hour, and can be opened completely or partially to permit access to the preparations in the desired compartments. The box can be opened by means of shutters arranged in the top of the box. Examples of such dispensers are described in EP-250 636, U.S. Pat. No. 4,038,937, U.S. Pat. No. 4,062,445 and FR-2,575,730.

The general trend in this field goes towards scrapping the insert once it has been emptied of its contents and removed from the box. Then, a new insert with medical preparations, prepared e.g. at a chemist's or a hospital, is inserted in the box.

W092/02202 describes a dispenser where the insert is delivered with a sheet fixed to it and covering the compartments therein. The sheet may be perforated, and the perforation should, with the insert placed in the box and a shutter opened, be broken to permit access to the preparation/preparations in the desired compartments. The sheet may alternatively be peeled off and folded back before the insert is inserted in its box.

The problem encountered in the first-mentioned embodiment is that the sheet portion forming a cover on its compartment will prevent or complicate the removal of the preparation/preparations from the compartments after the perforation has been broken by puncturing the sheet portion. The problem encountered in the second embodiment is that when the sheet is peeled off from the insert, the forces associated therewith may easily cause the insert to tremble, making the preparations leave their compartments so as to either drop to the floor or jump into a wrong compartment. This is especially the case with older people who often have shaky hands. The trembling effect is often aggravated by the insert often being of a thin, flexible plastics material.

The object of the invention is to find a solution to this problem.

This object is achieved by a dispenser and an insert according to the claims.

BRIEF DESCRIPTION OF THE DRAWINGS FIGURES

One embodiment of the invention will now be described in more detail with reference to the accompanying drawings.

FIG. 1 is an exploded view of a dispenser according to U.S. Pat. No. 4,038,937 with a first embodiment of the inventive concept applied to it.

DETAILED DESCRIPTION

Figure 1:
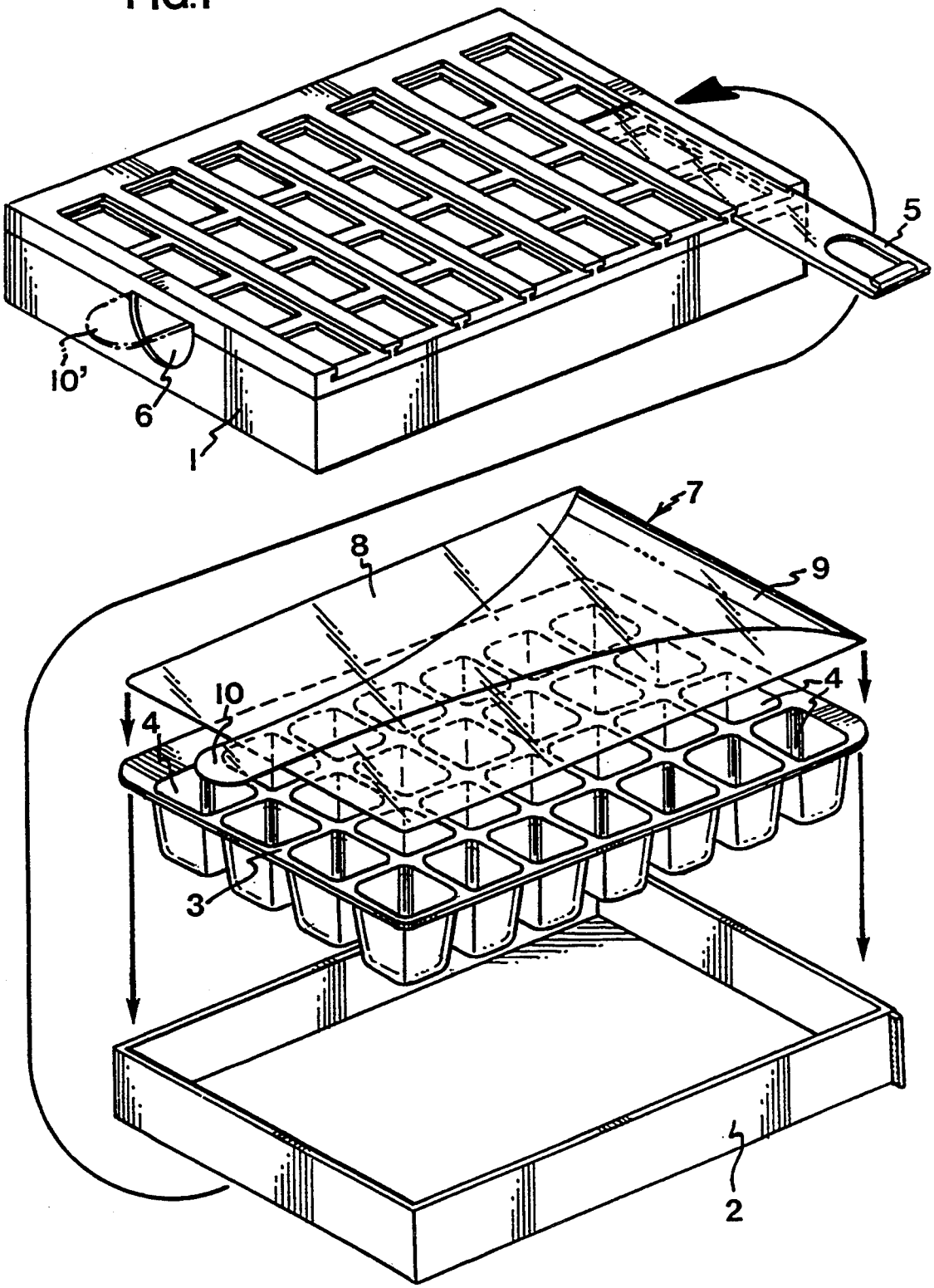

The prior-art dispenser of U.S. Pat. No. 4,038,937 has a box 1, a tray 2 and an insert 3 for receiving several (7×4) open-top compartments 4 for receiving medical preparations. The insert 3 fits in the tray 2 which is insertable, together with the insert, into the box 1 through one end thereof (the right-hand one in FIG. 1), whereupon access to the preparations in the compartments is offered after shutters 5 on the top of the box have been slid open. These components consist of plastics.

Opposite the tray-receiving end, the circumferential wall of the box 1 has a through opening 6 which is used for pushing, with a finger, the tray (with the insert) out of the box for reloading it with a new insert containing medical preparations.

The above summary of the known dispenser suffices for an understanding of the invention, which will now be exemplified in more detail.

According to the invention, the insert 3 is provided, e.g. at a chemist's where the insert has been filled with medicine, with a sheet for sealing it. This sheet is a pliable doubled strip 7 consisting e.g. of a viscose sheet or a suitable plastics material, whose lower ply 8 is attached all round the upper edge portion of the insert. The upper ply 9 of the strip lies loosely on the lower ply and is tapered so as to terminate at its free end in a finger grip portion 10, e.g. for the thumb and the forefinger. This grip portion 10 extends beyond the insert and is provided for peeling off the sheet or strip from the insert as described hereinafter. The position of the grip portion 10 is such that it can be reached and seized through the opening 6, or it extends through the opening 6 when the sealed insert 3 with its tray 2 has been inserted in the box with the side of the insert adjacent the grip portion 10 coming first. In order that the grip portion 10 should be automatically guided through the opening 6 after said insertion of the insert into the housing, it may be provided with a stiffened portion (see dash-dot line at grip portion 10').

The sealed insert 3 placed in the box is opened by pulling the grip portion 10 so that the connection between the lower ply 8 and the top of the insert is broken as the strip is peeled off through the opening 6. In this manner, the entire strip can be peeled off from the insert and drawn out of it.

The connection between the lower ply 8 of the strip and the insert 3 can be freely selected by a skilled person, depending on the material of the strip and the insert and the desired strength. If the materials are thermoplastics, it is preferred, for example, to employ continuous welding or spot welding. Joints can also be provided between the lower ply 8 and the upper edge portions of the compartments, if so desired.

In a modification, the upper ply 9 can be loosely attached in one or move points to the lower ply 8, suitably adjacent the grip portion 10, which ensures safer guiding of the grip portion up to and through the opening when inserting the insert in the box.

Figure 2:
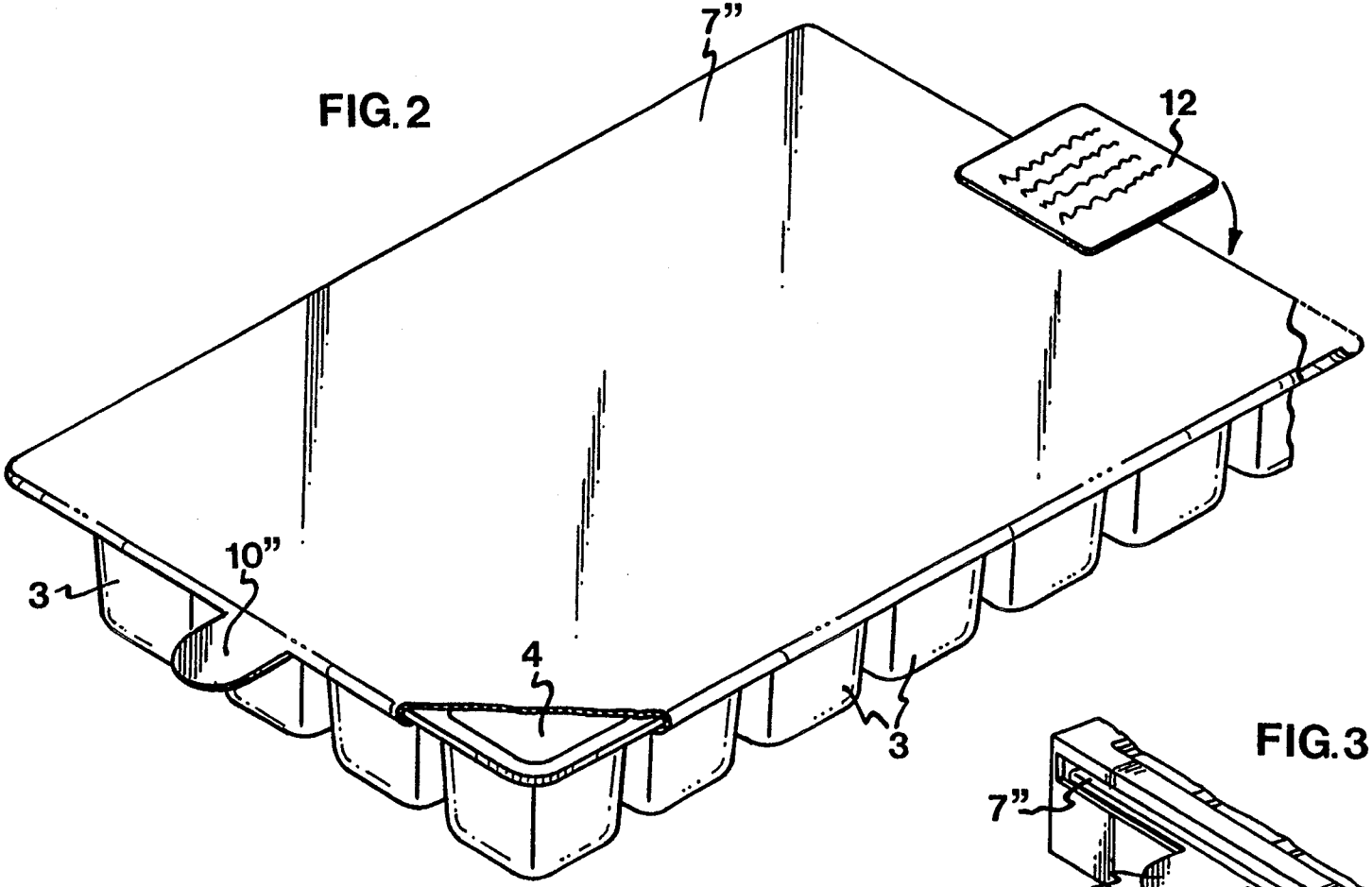
FIG. 2 shows a second embodiment of the inventive concept.
Figure 3:
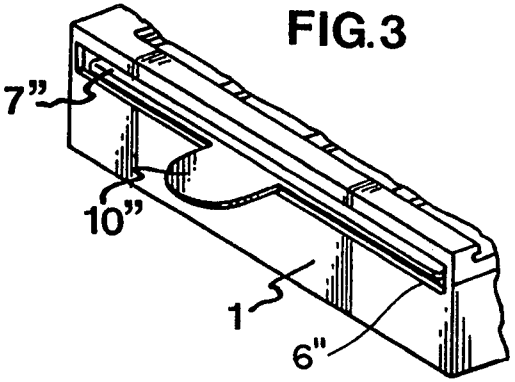
FIG. 3 shows a broken-way, modified part of FIG. 1.

In a further embodiment shown in FIG. 2, the insert 3 has a rectangular sliding lid (slide) 7'' of relatively rigid plastics material and shaped with inwardly folded edges on the two long sides and one short side, where one short side has been provided with a projecting tab 10''. On the opposite short side, the lid 7'' and the insert 3 are attached to each other by an adhesive strip 12, a "seal", which on the upper side may have medical directions, and which serves to prevent the lid 7″ from sliding off the insert and to make the insert and the lid tamperproof. This seal is broken, e.g. with the fingernail, before or after the insert 3 with the lid 7″ applied thereon has been inserted in the box 1 placed on a tray 2, with the same orientation as in FIG. 1. Alternatively, only the long sides may be provided with the inward folds, in which case also the other short side can be attached to the box by means of an adhesive strip. To permit removing the lid 7″ from the box by pulling the grip portion 10″, there are provided at the top of the corresponding short side of the tray 2 a recess and a slot 6″, see FIG. 3, in the corresponding short side of the box, the recess and the slot having such dimensions that the lid 7″ can be pulled out therethrough without any difficulty.

It is understood that the inventive concept is applicable to other types of dispensers than that illustrated, e.g. also to trayless dispensers, see EP-250 636 and SE-9101862.2, and such dispensers where the boxes are adapted to receive an insert through an open top which is closed by means of a lid hingedly connected to the box. According to the invention, such boxes (and/or their lids) are formed with an opening or a slot for reception and passage of the grip portion 10, 10′, 10″. Such an opening or slot etc. may possibly be dispensed with in boxes provided with pivotal lids and sheet-equipped inserts: here, the grip portion may extend out of the box in the gap between the top of the box and the lid. It is understood that the opening/slot 6, 6″, also in the trayless designs according to EP-250 636 and SE-9101862.2, is arranged in the box side opposite to the openable side.

I claim:

1. A dispenser for medical preparations, comprising a rectangular box (1) having an interior space;

an insert releasably contained in the box, the insert (3) having a plurality of countersunk compartments (4) for receiving medical preparations;

said box having a top cover with slidable shutters (5) adapted to be opened at least partially to permit access to the contents of the respective compartments;

a protective lid (7; 7″) removably positioned on a top of the insert to cover the compartments and being removably fastened to the insert to permit said access, wherein the lid (7; 7″) has a grip portion (10; 10″) which is seizable externally of one side of the box to permit removing the lid through one of an opening and a slot (6; 6″) in said side of the box.

2. A dispenser as claimed in claim 1, wherein the lid (7) comprises a pliable protective sheet in the form of a doubled strip (7) a lower ply removably fixed to the upper edge of the insert (2) and an upper ply (9) lies on the lower ply (8) the upper ply having at a free end said grip portion (10; 10′) the grip portion being accessible from outside the box to peel the lid from the insert through, the opening.

3. A dispenser as claimed in claim 1, wherein the lid (7″) comprises a slide which is shaped along at least two opposite edges with an inward folded portion and shaped on a third edge with said grip portion (10″), said inward folded portions gripping upper corresponding edge portions of the insert (3), wherein the slide is removable through the slot.

4. An insert for use in a dispenser for medical preparations comprising;

a body having a plurality of countersunk compartments (4) for receiving medical preparations;

a pliable protective sheet comprising a doubled strip (7) having a lower ply (8) removably fastened to an upper edge of the body and an upper ply (9) positioned to lie on the lower ply (8), the upper ply having at a free end a grip portion (10) which extends outside a periphery of an upper edge of the body.

5. An insert for use in a dispenser for medical preparations, comprising:

an insert (3) having a rectangular shape with outwardly extending upper edge portions and containing a plurality of countersunk compartments (4) for receiving medical preparations; and a lid having inwardly-folded edge portions along at least two opposite sides positioned on a top of the insert with said inwardly-folded edge portions gripping the upper, corresponding edge portions of the insert, the lid being displaceable from the insert by relative sliding along the inwardly-folded edge portions, and a seal in the form of an adhesive strip is attached to the insert and at least one of the edge portions having no inward fold.

6. A dispenser as claimed in claim 2, wherein the upper ply is removably fastened to the lower ply adjacent to the grippable portion.

7. A dispenser as claimed in claim 3, wherein the third edge of the slide is shaped with an inward folded portion to grip a corresponding upper edge of the insert.

8. An insert as claimed in claim 4, wherein the upper ply is removably fastened to the lower ply adjacent to the grippable portion.

9. An insert as claimed in claim 5, wherein a third edge of the lid is shaped with an inwardly-folded edge portion to grip a corresponding upper edge portion of the insert.

* * * * *